US006071071A

United States Patent [19]

Mohring

[11] Patent Number: 6,071,071

[45] Date of Patent: Jun. 6, 2000

[54] SIDE-CHANNEL FAN, IN PARTICULAR FOR SUPPLYING COMBUSTION AIR IN AN INDEPENDENT HEATER OF A MOTOR VEHICLE

[75] Inventor: Fritz Mohring, Ostfildern, Germany

[73] Assignee: J. Eberspächer GmbH & Co., Germany

[21] Appl. No.: 09/202,219

[22] PCT Filed: Jul. 2, 1997

[86] PCT No.: PCT/DE97/01404

§ 371 Date: Dec. 9, 1998

§ 102(e) Date: Dec. 9, 1998

[87] PCT Pub. No.: WO98/02663

PCT Pub. Date: Jan. 22, 1998

[30] Foreign Application Priority Data

Jul. 16, 1996 [DE] Germany ..... 196 28 597
Aug. 2, 1996 [DE] Germany ..... 196 31 257

[51] Int. Cl.[7] ..... F01D 1/12

[52] U.S. Cl. ..... 415/55.4; 415/55.1; 415/55.2; 415/55.3; 237/12.3 C

[58] Field of Search ..... 415/55.1, 55.2, 415/55.3, 55.4, 55.5, 55.6, 55.7; 237/12.3 C, 12.3 R

[56] References Cited

U.S. PATENT DOCUMENTS 3,324,799 6/1967 Terrano .
3,951,567 4/1976 Rohs ..... 415/55.3

FOREIGN PATENT DOCUMENTS 0 636 792 2/1995 European Pat. Off. .
1 528 705 5/1969 Germany .
42 30 014 3/1994 Germany .
94 20 591 U 3/1995 Germany .
56-165795 12/1981 Japan .
4-03105095 5/1991 Japan ..... 415/55.4
1 496 781 1/1978 United Kingdom .

*Primary Examiner*—Edward K. Look
*Assistant Examiner*—Lian McDowell
*Attorney, Agent, or Firm*—McGlew and Tuttle P.C.

[57] ABSTRACT

A side-channel fan (1), especially for feeding combustion air in a parking heater (2) of a motor vehicle, with a fan body part (3) in an axial connection to an impeller (4), wherein the fan body part (3) has an inlet channel (5) and an outlet channel (6) and, the axial connection side (7) of the impeller, a bent side channel (8) connecting the inlet channel to the outlet channel, and an interrupter (9), which together form the 360° circumference of the axial connection side (7), and at least one of the openings connecting the side channel (8) to the inlet channel (5) and to the outlet channel (6) is provided with a cover (10) in the area of the axial connection side (7), characterized in that the entire surface of the cover (10) located opposite the axial connection side or surface of the impeller (4) is arranged deeper, i.e., at a distance (d), in relation to the axial connection side.

20 Claims, 4 Drawing Sheets

SIDE-CHANNEL FAN, IN PARTICULAR FOR SUPPLYING COMBUSTION AIR IN AN INDEPENDENT HEATER OF A MOTOR VEHICLE

FIELD OF THE INVENTION

The present invention pertains to a side-channel fan, especially for feeding combustion air in a parking heater or auxiliary heater of a motor vehicle, with a fan body part in an axial connection to an impeller, wherein the fan body part has an inlet channel and an outlet channel and a bent side channel connecting the inlet channel to the outlet channel on the axial connection side of the impeller, and an interrupter, which together form the 360° circumference of the axial connection side.

BACKGROUND OF THE INVENTION

A side-channel fan of the above-described type has been known from DE 42 30 014 C1. The interrupter has baffling means in the form of material recesses, e.g., notch-like recesses, which reduce the generation of noise during the operation of the fan.

The difficult and expensive manufacture of the fan body is a drawback. Complex, spatially difficult flow channels and baffling means can be prepared only by casting or mechanical surface finishing. Flow optimization and noise optimization or minimization are therefore possible at an acceptable expense to a limited extent only.

SUMMARY AND OBJECTS OF THE INVENTION

The object of the present invention is to provide a side-channel fan of the type described in the introduction, which makes it possible to optimize the noise and flow by means of simple means.

According to the invention, a side-channel fan is provided especially for feeding combustion air in a parking heater of a motor vehicle. The fan includes a fan body part in an axial connection to an impeller. The fan body part has an inlet channel and an outlet channel and, on the axial connection side of the impeller, a bent (or curved) side channel connecting the inlet channel to the outlet channel, and an interrupter, which together form the 360° circumference of the axial connection side. At least one of the openings connecting the side channel to the inlet channel and to the outlet channel is provided with a cover in the area of the axial connection side. The entire surface of the cover is located opposite the axial connection side or surface of the impeller and is arranged deeper, i.e., at a distance (d), in relation to the axial connection side.

The essence of the present invention is the design of a set-back cover in the area of at least one of the openings, which connect the side channel to the inlet channel and to the outlet channel. The cover is located on the axial connection side of the impeller directly connected to the interrupter and is set back in relation to the interrupter. The amount of the setback is, in particular, 0.3 mm.

The cover is preferably a separate component, which is fastened to the edge of the interrupter and/or the edge of the side channel by means of fastening means. The fastening means are preferably bolts, which engage cored holes of the fan body part. Detachable or nondetachable fastening means may be provided, in general.

An arrangement of an especially simple design is obtained if the cover is a plate.

The cover advantageously has at least one curved air guide section, which is made in one piece or fastened and is located on the side of the cover facing the opening of the inlet or outlet channel.

The edge of the cover facing the side channel may also have a tapered air flow edge in a correspondingly flow-optimized manner.

For noise minimization, the aforementioned edge preferably has at least one nonstraight shaped projection and/or a corresponding negative recess, when viewed from the top in the direction of the axis of the impeller.

However, the edge of the cover facing the side channel may also have a wave shape or another shape when viewed from the top and its shape is determined, in particular, by experiments.

A compact arrangement and a simple possibility of fastening is obtained if the cover is designed as an essentially sector-shaped cover when viewed from the top.

The cover is preferably a plastic or metal part, especially one made of aluminum.

The cover, which is preferably made as a one-piece casting, may have on the impeller side flat recesses and/or elongated grooves, which extend, in particular, in the radial direction of the impeller.

Due to the cover being set back axially in relation to the impeller, which cover may be provided as a casting in one piece with the fan body part or as a separate component, machining of the side of the cover facing the impeller is eliminated. In a mounted impeller, the setback creates a hollow space or gap, which substantially contributes to the noise minimization of the fan during operation, similarly to the prior-art design of the notches at the edge of the opening according to DE 42 30 014 C1, doing so with simpler means. The elimination of the subsequent machining of the cover leads to a simplification of manufacture. If the cover is a separate component, especially a plate with a special configuration of the incoming or discharge flow edge facing the side channel, different fan constellations can be taken into account with the same basic fan body part and different cover plates with different incoming or discharge flow edges. As a result, a fan that is identical per se may be designed for different speeds of rotation in a noise-optimized manner by changing only the cover.

It is obvious that the cover may also be used together with the prior-art notches of the baffling means according to DE 42 30 014 C1.

Provisions may therefore be made, in particular, for providing one of the two openings connecting the side channel to the inlet channel and the outlet channel in the area of the axial connection side with the cover, while the other of the two openings is provided with at least one notch.

It has proved to be particularly advantageous for the cover to be associated with the outlet channel or the pressure side of the fan and for the notch(es) to be associated with the inlet channel or the suction side of the fan.

The notches preferably have a V-shaped cross section.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
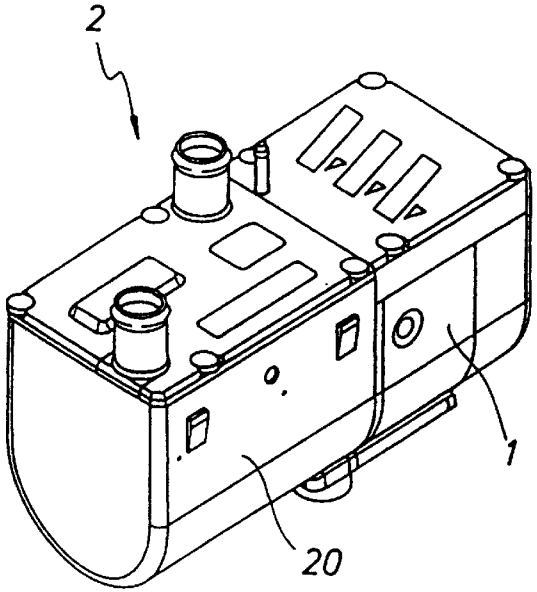
FIG. 1 is a schematic perspective view of a parking heater of a motor vehicle, with a side-channel fan for feeding combustion air to the burner with heat exchanger.

Referring to the drawings in particular, FIG. 1 shows a side-channel fan 1, which is connected to a burner 20 with heat exchanger and supplies the burner 20 with combustion air during operation. The side-channel fan 1 is provided in a parking heater 2 or auxiliary heater of a motor vehicle.

Figure 2:
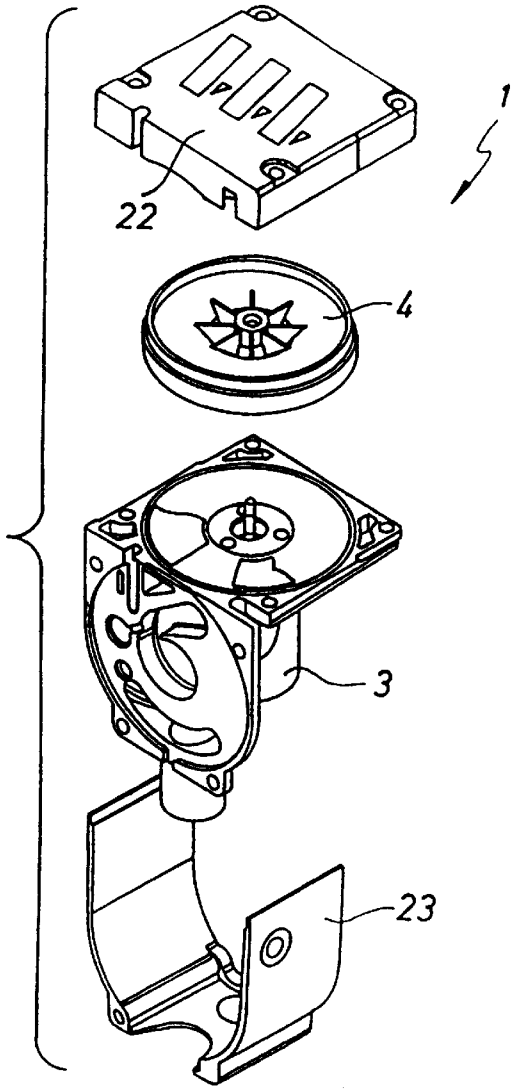
FIG. 2 is a schematic exploded view of the side-channel fan according to FIG. 1 with a central fan body part.

The side-channel fan 1 has, besides an upper and lower cover 22, 23, an impeller 4 and a fan body part 3 in an axial connection to the impeller 4, as can be seen especially in the exploded view according to FIG. 2.

Figure 3:
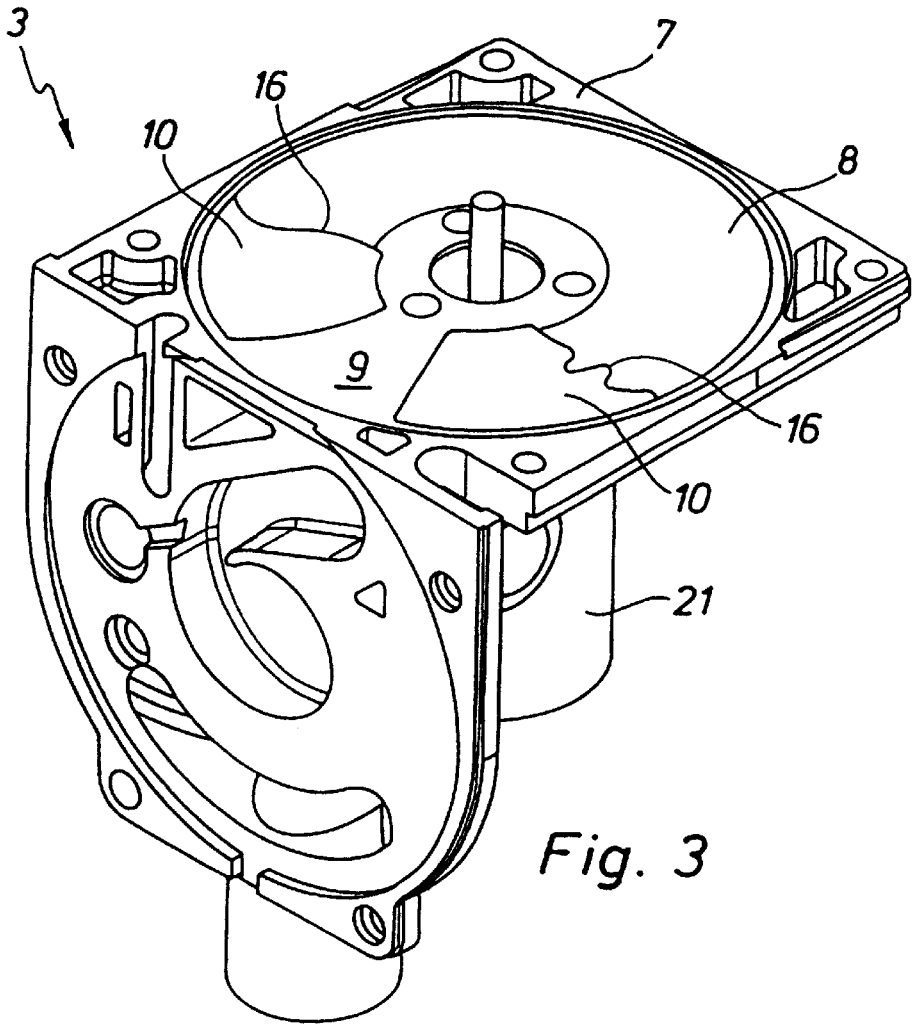
FIG. 3 is an enlarged perspective view of the side-channel fan according to FIG. 2.

The fan body part 3 that is of interest here is shown as a larger detail in FIG. 3.

The fan body part 3 is made of three pieces. It has a cast basic fan body part and two covers 10 made of aluminum, as will be described below.

The basic fan body part comprises an inlet channel 5 for admitting combustion air from the atmosphere and an outlet channel 6 for discharging the accelerated combustion air to the combustion chamber of the burner 20.

On the axial connection side 7 of the impeller 4, the fan body part 3 has a side channel 8 of a half-toric shape, which connects the inlet channel 5 to the outlet channel 6 and in which the combustion air is accelerated during operation by an impeller 4 driven by an electric motor 21.

The side channel 8 extends over an arc of about 270° on the axial connection side 7. The rest of the axial connection side 7 is essentially an interrupter 9, which is an integrated part of the cast basic fan body part.

Figure 4:
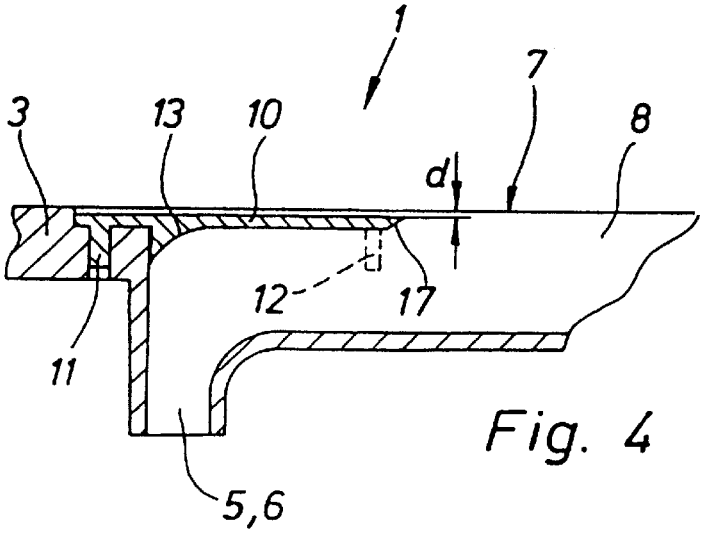
FIG. 4 is a schematic vertical sectional view of the fan body part according to FIG. 3 in the area of the cover.
Figure 5:
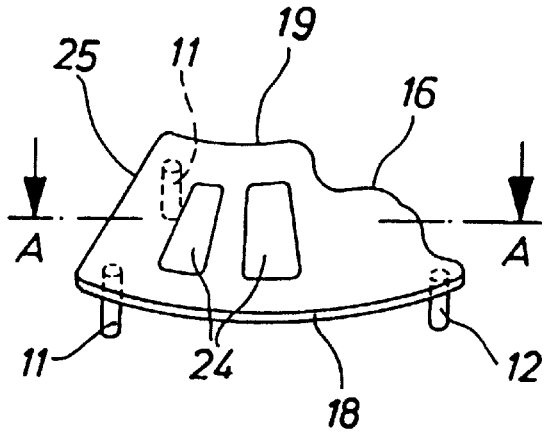
FIG. 5 is a schematic perspective view of the cover of the fan body part according to FIG. 3.
Figure 6:
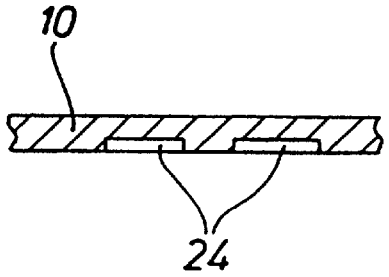
FIG. 6 is a partial sectional view of the cover according to FIG. 5 along line A—A.

The two covers 10 according to FIG. 3, which are shown as larger details in FIGS. 4, 5 and 6, are located essentially on the axial connection side 7 of the fan body part. In particular, the covers 10 cover the two openings connecting the side channel 8 to the inlet channel 5 and the outlet channel 6 axially in the direction of the impeller.

The covers 10 are arranged deeper in relation to the axial connection side 7 or surface of the impeller 4 at a distance d of about 0.3 mm.

The covers 10, designed as separate components, are fastened at two points to the edge of the interrupter 9 and at one point on the outside to the bent edge of the side channel 8 via fastening means in the form of bolts 11, 12, which engage cored holes of the fan body part 3.

On the impeller side, the covers 10 have two flat recesses 24, which extend essentially in the radial direction in relation to the impeller 4, as can be seen especially in FIGS. 5 and 6.

The covers 10 are designed as plates and have a curved air guide section 13, which is made in one piece and is located on the side of the covers facing the inlet channel and the outlet channel.

The edge 16 of each cover 10, which edge faces the side channel 8, has a tapered air flow edge 17, which has an irregular wave shape when viewed from the top.

On the whole, each cover 10 has essentially a sector shape when viewed from the top with a convexly bent outer edge 18 and with a concavely bent inner edge 19 as well as with an essentially straight, radial edge 25 on the interrupter side, while the rest of the edge 16 and the incoming/discharge edge have the aforementioned wave shape.

Figure 7:
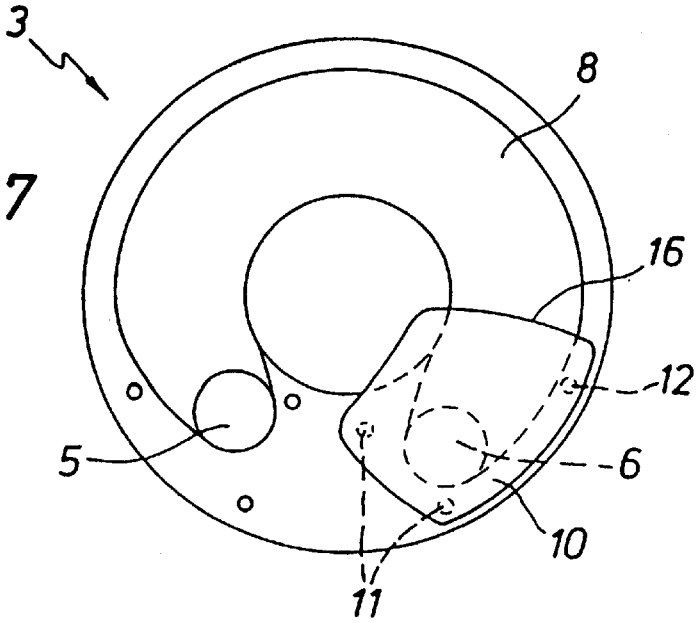
FIG. 7 is a schematic top view of the fan body part according to FIG. 3 with a different configuration of the cover on the discharge side of the side channel.

In another embodiment, the edge 16 and the incoming/discharge edge of the cover 10 are bent slightly concavely according to FIG. 7. This is described only as an example for a plurality of other variants.

Figure 8:
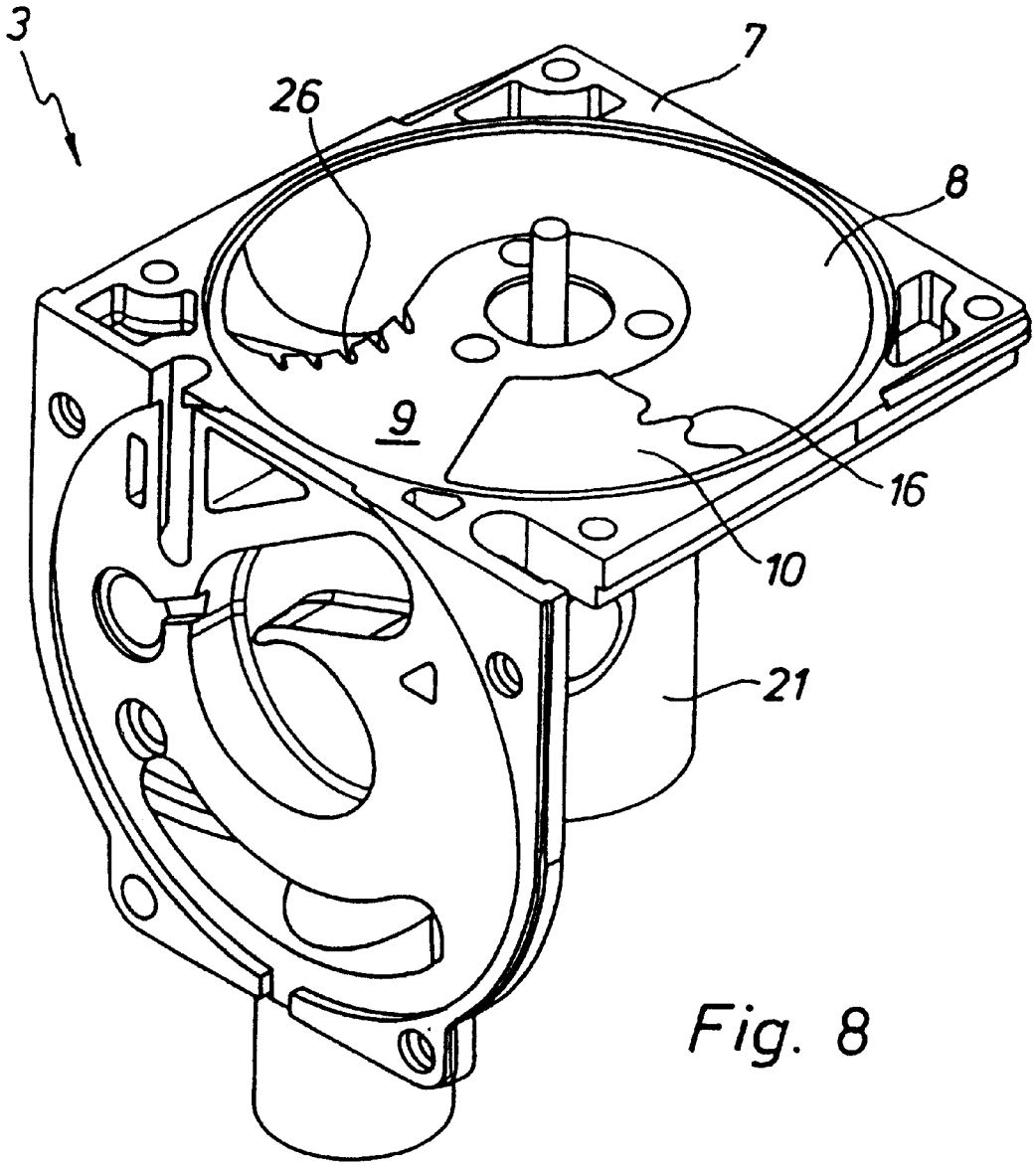
FIG. 8 is a perspective view showing another design of the fan body part similar to that in FIG. 3.

Finally, FIG. 8 shows a fan body part 3 similar to that shown in FIG. 3, in which one of the two openings connecting the side channel 8 to the inlet channel 5 and to the outlet channel 6 is provided in the area of the axial connection side 7 with a cover 10, and the other of the two openings is provided with notches 26. In particular, the cover 10 is associated here with the outlet channel 6 or the pressure side of the fan, and the notches 26 are associated with the inlet channel 5 or the suction side of the fan. The notches 26 have a V-shaped cross section.

While specific embodiments of the invention have been shown and described in detail to illustrate the application of the principles of the invention, it will be understood that the invention may be embodied otherwise without departing from such principles.

What is claimed is:

1. A side-channel fan for feeding combustion air in a parking heater of a motor vehicle, the side-channel fan comprising:

an impeller;

a fan body part with an axial connection to said impeller, said fan body part having an inlet channel and an outlet channel on a side of said axial connection of said impeller, a bent side channel connecting said inlet channel to the said outlet channel, an interrupter, said interrupter together with said side channel forming a 360° circumference of said side of said axial connection, an opening connecting said side channel to said inlet channel and an opening connecting said side channel to said outlet channel;

a cover in the area of said side of said axial connection side provided with at least one of said openings, an entire surface of said cover which is located opposite said side of said axial connection or surface of said impeller is arranged deeper by a distance in relation to said side of said axial connection.

2. The side-channel fan in accordance with claim 1, wherein said distance is about 0.3 mm.

3. The side-channel fan in accordance with claim 1, wherein said cover is a separate component, which is fastened to an edge of at least one of said interrupter and the edge of said side channel via fastening means.

4. The side-channel fan in accordance with claim 3, wherein said fastening means are bolts, which engage cored holes of said fan body part.

5. The side-channel fan in accordance with claim 3, wherein said cover is a plate.

6. The side-channel fan in accordance with claim 1, wherein said cover has at least one curved air guide section which is made in one piece with said cover or is fastened to it, said curved air guide section being located on a side of said cover facing said opening of the inlet or outlet channel.

7. The side-channel fan in accordance with claim 1, wherein an edge of said cover facing said side channel has a tapered air flow edge.

8. The side-channel fan in accordance with claim 1, wherein an edge of said cover facing said side channel has at least one of a nonstraight shaped projection and a non-straight shaped recess when viewed from the top.

9. The side-channel fan in accordance with claim 1, wherein an edge of said cover facing said side channel has a wave shape when viewed from the top.

10. The side-channel fan in accordance with claim 1, wherein said cover is essentially sector-shaped when viewed from the top.

11. The side-channel fan in accordance with claim 1, wherein said cover is a plastic or metal part.

12. The side-channel fan in accordance with claim 1, wherein said cover is made of aluminum.

13. The side-channel fan in accordance with claim 1, wherein said cover has at least one of a flat recess and an elongated groove on a side facing said impeller.

14. The side-channel fan in accordance with claim 12, wherein at least one of said recess and said groove extend in a radial direction of said impeller.

15. The side-channel fan in accordance with claim 1, wherein one of said openings connecting said side channel to said inlet channel and to said outlet channel is provided in an area of said side of said axial connection with said cover, and the other of said openings is provided with at least one notch.

16. The side-channel fan in accordance with claim 15, wherein said cover is associated with said outlet channel or a pressure side of the fan, and said notch is associated with said inlet channel or the suction side of the fan.

17. The side-channel fan in accordance with claim 15, wherein said notch has a V-shaped cross section.

18. A side-channel fan comprising:

an impeller;

a fan body part with an axial connection to said impeller, said fan body part having an inlet channel and an outlet channel, a bent side channel connecting said inlet channel to the said outlet channel, said bent side channel being on a side of said axial connection of said impeller, an interrupter, said interrupter together with said side channel forming a 360° circumference of said side of said axial connection, an inlet opening connecting said side channel to said inlet channel and an outlet opening connecting said side channel to said outlet channel;

a cover provided with one of said outlet opening and said inlet opening, said cover being provided in the area of said axial connection, an entire surface of said cover which is located opposite a surface of said impeller is arranged deeper by a distance in relation to said side of said axial connection.

19. The side-channel fan in accordance with claim 18, wherein said cover is a separate component, which is fastened to an edge of at least one of said interrupter and the edge of said side channel via fastening means.

20. The side-channel fan in accordance with claim 19, wherein said fastening means are bolts, which engage cored holes of said fan body part.

* * * * *